US005141151A

United States Patent [19]

Faulstick

[11] Patent Number: 5,141,151

[45] Date of Patent: Aug. 25, 1992

[54] UNITARY LIGHT-TIGHT FLIP-TOP PACKAGE

[75] Inventor: Luke T. Faulstick, Rochester, N.Y.

[73] Assignee: Eastman Kodak Company, Rochester, N.Y.

[21] Appl. No.: 796,735

[22] Filed: Nov. 25, 1991

[51] Int. Cl.[5] ..... B65D 81/30; B65D 85/671

[52] U.S. Cl. ..... 229/145

[58] Field of Search ..... 206/316.1, 389, 395, 206/396, 397, 455, 456; 229/145-147, 159, 172; 242/71.7

[56] References Cited

U.S. PATENT DOCUMENTS

| | | | |
|---|---|---|---|
| 690,575 | 1/1902 | Herre | 229/145 |
| 1,425,713 | 8/1922 | Stokes | 229/146 |
| 1,994,541 | 3/1935 | Spiking | 229/146 |
| 2,588,377 | 3/1952 | Frankenstein | 229/145 |
| 2,640,642 | 6/1953 | Frankenstein | 229/145 |
| 2,650,015 | 8/1953 | Frankenstein | 229/145 |
| 4,306,687 | 12/1981 | Hadke | 242/55.53 |
| 4,326,634 | 4/1982 | Meyers | 229/145 |
| 4,391,405 | 7/1983 | Drinon | 229/145 |
| 4,405,066 | 9/1983 | Roccaforte | 225/43 |
| 4,417,678 | 11/1983 | Roccaforte | 225/43 |
| 4,645,108 | 2/1987 | Gavin et al. | 225/103 |
| 5,022,524 | 6/1991 | Grady | 206/395 |
| 5,029,709 | 7/1991 | Faulstick | 206/455 |

*Primary Examiner*—Jimmy G. Foster
*Attorney, Agent, or Firm*—Clyde E. Bailey

[57] ABSTRACT

A unitary light-tight flip-top package, for securely containing light-sensitive material, comprises (1) a closable and openable rectanguloid box having bottom, front, rear, and opposite end walls and (2) a mating lid having a top wall movably connected to the box rear wall, with front and opposite end walls depending therefrom in close confronting relation to the corresponding box walls. The box and the lid walls are all formed from a single paperboard blank that is specially configured with various panels and flaps adapted to be folded into close cooperative relationships providing the unitary light-tight flip-top package desired.

7 Claims, 2 Drawing Sheets

UNITARY LIGHT-TIGHT FLIP-TOP PACKAGE

BACKGROUND OF THE INVENTION

1. Field of the Invention

The present invention relates generally to packaging, and particularly to a light-tight package for securely containing light-sensitive material, such as a roll of photosensitive web material.

2. Description of the Prior Art

Packaging arrangements for containing rolls of web material, including photosensitive web material, are well known in the prior art. Examples may be found in the following patents:

U.S. Pat. No. 4,306,687 (Hadtke)—Discloses a web-roll dispensing container formed from a single paperboard blank that is so configured and folded as to provide a means for keeping the web-roll centered therein with its outer end projecting from an exit slot.

U.S. Pat. No. 4,405,066 (Roccaforte)—Discloses a web-roll dispensing container formed from a single paperboard blank that is so configured as to be readily foldable by automated equipment into a securely closed flip-top carton having a reinforced web-cutting edge.

U.S. Pat. No. 4,417,678 (Roccaforte)—Discloses a web-roll dispensing container formed from a single paperboard blank that is so configured as to be foldable into a sealed flip-top carton having a web-cutting edge and means for readily breaking the flip-top seal.

U.S. Pat. No. 4,645,108 (Gavin et al.)—Discloses a web-roll dispensing container formed from a single paperboard blank that is so configured as to be foldable into a sealed flip-top carton having self-locking end flaps.

U.S. Pat. No. 5,022,524 (Grady)—Discloses a rectanguloid flip-top box for securely containing a photosensitive web-roll, the box being formed from a single paperboard blank having various panels and flaps that are foldable into close interfitting relationships.

U.S. Pat. No. 5,029,709 (Faulstick)—Discloses a rectanguloid flip-top box for securely containing a stack of rectangular photosensitive film sheets, the box being formed from a single paperboard blank having various panels and flaps that are foldable into close interfitting relationships.

While prior-art arrangements such as those described above may have sufficed for their own particular purposes, there has remained, nonetheless, a need for an improved packaging arrangement that is especially adapted for efficient on-line assembly to protectively contain a quantity of photosensitive material, and which also is adapted for convenient opening and light-tight reclosing when in use.

An overall object of this invention, therefore, has been to provide a packaging arrangement that meets the foregoing need, and to do so in a practical, cost-effective, and reliable manner.

SUMMARY OF THE INVENTION

In accordance with that object, and as shown and described herein, the present invention finds utility in a light-tight package for securely containing light-sensitive material. The package comprises (1) a closable and openable rectanguloid box, the box having a bottom wall, a front wall, a rear wall, and opposite end walls, and (2) a mating lid movably connected to the box rear wall, the lid having a top wall with a front wall and opposite end walls depending therefrom. The box and lid walls are all formed from a single sheet, or blank, of corrugated paperboard that includes:

a rectangular box-bottom-wall panel defined by longitudinal box-bottom-wall front and rear fold lines and transverse box-bottom-wall opposite end fold lines;

a rectangular box-front-wall outer panel defined by the box-bottom-wall front fold line, a longitudinal box-front-wall fold line, and transverse box-front-wall outer-panel opposite end fold lines;

a box-front-wall inner panel defined by the box-front-wall fold line, a substantially longitudinal box-front-wall inner-panel bottom edge, and transverse box-front-wall inner-panel opposite end edges;

a rectangular box-rear-wall panel defined by the box-bottom-wall rear fold line, a longitudinal box-rear-wall fold line, and transverse box-rear-wall opposite end fold lines;

box-opposite-end-wall inner-intermediate panels defined by the box-rear-wall opposite end fold lines respectively, transverse box-opposite-end-wall inner-intermediate-panel end edges respectively, and longitudinal box-opposite-end-wall inner-intermediate-panel bottom and top edges;

box-opposite-end-wall outer-intermediate panels defined by the box-bottom-wall opposite end fold lines respectively, transverse box-opposite-end-wall outer-intermediate-panel end edges respectively, and longitudinal box-opposite-end-wall outer-intermediate-panel front and rear edges;

rectangular box-opposite-end-wall outer panels defined by the box-front-wall outer-panel opposite end fold lines respectively, transverse box-opposite-end-wall outer-panel end edges respectively, longitudinal box-opposite-end-wall outer-panel bottom edges respectively, and longitudinal box-opposite-end-wall outer-panel fold lines respectively;

box-opposite-end-wall top panels defined by the box-opposite-end-wall outer-panel fold lines respectively, longitudinal box-opposite-end-wall top-panel fold lines respectively, and transverse box-opposite-end-wall top-panel front and rear edges;

box-opposite-end-wall inner panels defined by the box-opposite-end-wall top-panel fold lines respectively, longitudinal box-opposite-end-wall inner-panel bottom edges respectively, transverse box-opposite-end-wall inner-panel front edges respectively, and transverse box-opposite-end-wall inner-panel fold lines respectively;

box-opposite-end-wall inner-panel lightlock flaps defined by the box-opposite-end-wall inner-panel fold lines respectively, transverse box-opposite-end-wall inner-panel lightlock-flap end edges respectively, and substantially longitudinal box-opposite-end-wall inner-panel lightlock-flap bottom and top edges;

a rectangular lid-top-wall panel defined by the box-rear-wall fold line, a longitudinal lid-top-wall fold line, and transverse lid-top-wall opposite end fold lines;

a rectangular lid-front-wall outer panel defined by the longitudinal lid-top-wall fold line, a longitudinal lid-front-wall fold line, and transverse lid-front-wall outer-panel opposite end edges;

a lid-front-wall inner panel defined by the lid-front-wall fold line, a substantially longitudinal lid-front-wall inner-panel top edge, and transverse lid-front-wall inner-panel opposite end edges;

substantially rectangular lid-opposite-end-wall panels defined by the lid-top-wall opposite end fold lines respectively, transverse lid-opposite-end-wall panel end edges respectively, longitudinal lid-opposite-end-wall panel rear edges respectively, and longitudinal lid-opposite-end-wall panel fold lines respectively; and lid-front-wall intermediate partial panels defined by the lid-opposite-end-wall panel fold lines respectively, substantially longitudinal lid-front-wall intermediate-partial-panel end edges respectively, and transverse lid-front-wall intermediate-partial-panel top and bottom edges;

the box-bottom-wall panel, as defined by the box-bottom-wall front and rear fold lines and the box-bottom-wall opposite end fold lines, forming the box bottom wall;

the box-front-wall outer and inner panels being folded about the box-bottom-wall front fold line and the box-front-wall fold line, respectively, into adjacent confronting relation with each other to form the box front wall;

the box-rear-wall panel being folded about the box-bottom-wall rear fold line into spaced confronting relation with the folded box-front-wall inner panel to form the box rear wall;

the box-opposite-end-wall inner-intermediate panels being folded about the box-rear-wall opposite end fold lines, respectively, into spaced confronting relation with each other;

the box-opposite-end-wall outer-intermediate panels being folded about the box-bottom-wall opposite end fold lines, respectively, into adjacent confronting relation with the folded box-opposite-end-wall inner-intermediate panels respectively;

the box-opposite-end-wall outer panels being folded about the box-front-wall outer-panel opposite end fold lines, respectively, into adjacent confronting relation with the folded box-opposite-end-wall outer-intermediate panels respectively;

the box-opposite-end-wall top panels being folded about the box-opposite-end-wall outer-panel fold lines, respectively, into confronting relation with the folded box-opposite-end-wall outer-intermediate-panel end edges respectively and the folded box-opposite-end-wall inner-intermediate-panel top edges respectively;

the box-opposite-end-wall inner panels being folded about the box-opposite-end-wall top-panel fold lines, respectively, into adjacent confronting relation with the folded box-opposite-end-wall inner-intermediate panels respectively;

the box-opposite-end-wall inner-panel lightlock flaps being folded about the box-opposite-end-wall inner-panel fold lines, respectively, into adjacent confronting relation with opposite end portions of the box-rear-wall panel respectively;

the box-opposite-end-wall outer, outer- and inner-intermediate, inner, and top panels, so folded, together forming the box opposite end walls respectively;

the lid-top-wall panel, as defined by the box-rear-wall fold line, the longitudinal lid-top-wall fold line, and the transverse lid-top-wall opposite end fold lines, forming the lid top wall;

the lid-opposite-end-wall panels being folded about the lid-top-wall opposite end fold lines, respectively, into spaced confronting relation with each other to form the lid opposite end walls respectively;

the lid-front-wall intermediate partial panels being folded about the lid-opposite-end-wall panel fold lines, respectively, toward and into substantial alignment with each other;

the lid-front-wall outer panel being folded about the longitudinal lid-top-wall fold line into adjacent confronting relation with the folded lid-front-wall intermediate partial panels; and the lid-front-wall inner panel being folded about the lid-front-wall fold line, over the folded lid-front-wall intermediate-partial-panel bottom edges, in between the folded lid-opposite-end-wall panels, and into adjacent confronting relation with the folded lid-front-wall intermediate partial panels;

the lid-front-wall outer, intermediate partial, and inner panels, so folded, together forming the lid front wall;

the lid-top-wall panel then being folded forwardly and downwardly about the box-rear-wall fold line so as to move opposite end portions of the folded lid-top-wall panel into adjacent confronting relation with the folded box-opposite-end-wall top panels respectively, the folded lid-opposite-end-wall panels into adjacent confronting relation with the folded box-opposite-end-wall outer panels respectively, and the folded lid-front-wall inner panel into adjacent confronting relation with the folded box-front-wall outer panel, to close the box and thereby form the light-tight package for securely containing light-sensitive material.

This invention, and its objects and advantages, will become more apparent in the detailed description of a preferred embodiment thereof presented hereinbelow.

BRIEF DESCRIPTION OF THE DRAWINGS

In the detailed description of the preferred embodiment of this invention set forth below, reference is made to the accompanying drawings, wherein like reference characters denote like elements, and wherein.

DESCRIPTION OF THE PREFERRED EMBODIMENT

Because certain parts of packaging arrangements are well known, the following description is directed in particular to those elements forming, cooperating directly with, or relating especially to, this invention. Elements not specifically shown or described herein are selectable from those known in the pertinent art.

Figure 1:
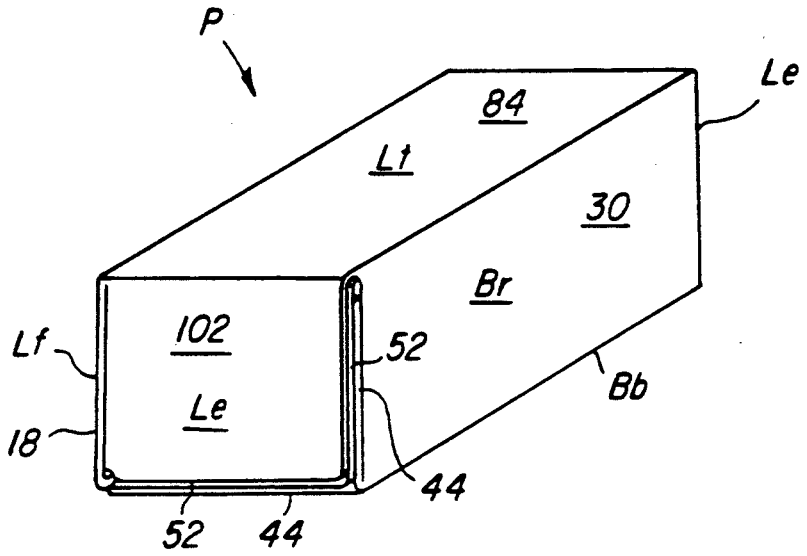
FIG. 1 is a top-rear-end perspective view of a light-tight package constructed according to the preferred embodiment, showing that package in its fully closed condition.
Figure 2:
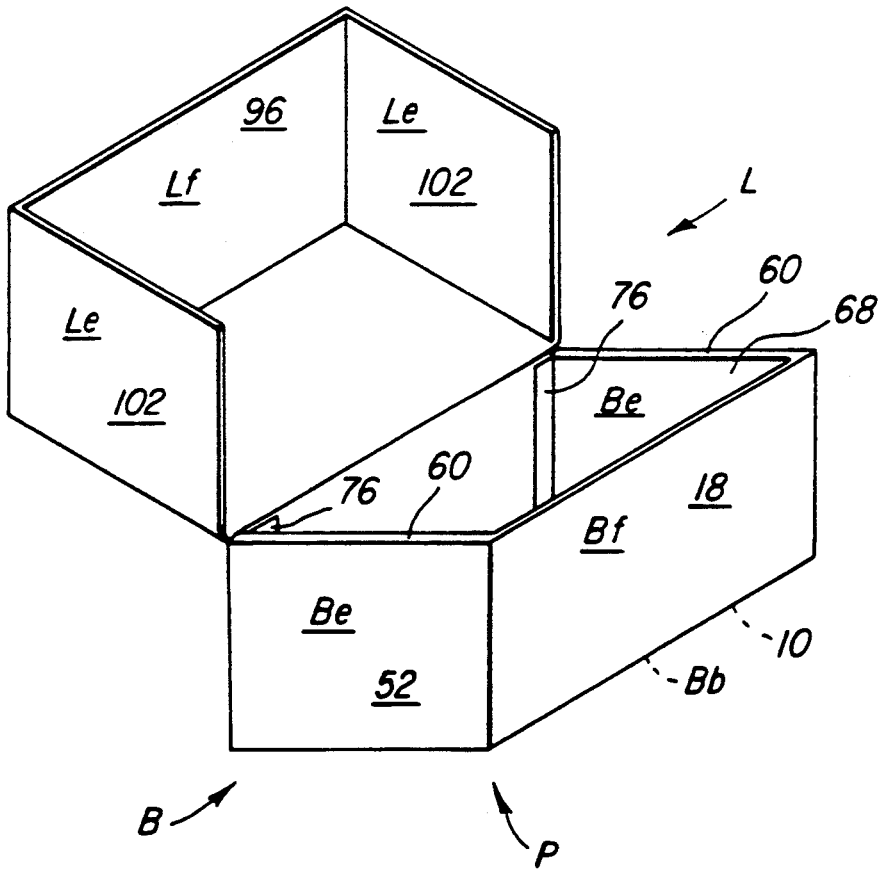
FIG. 2 is a top-front-end perspective view showing the package of FIG. 1 in an open condition, and revealing box and lid components thereof.

Illustrated in FIGS. 1 and 2 is a unitary light-tight flip-top package P for securely containing light-sensitive material, such as a roll of photosensitive web material, not shown. The package P comprises (1) a closable and openable rectanguloid box B, the box having a bottom wall Bb, a front wall Bf, a rear wall Br, and opposite end walls Be, and (2) a mating lid L movably connected to the box rear wall Br, the lid having a top wall Lt with a front wall Lf and opposite end walls Le extending perpendicularly therefrom.

Figure 3:
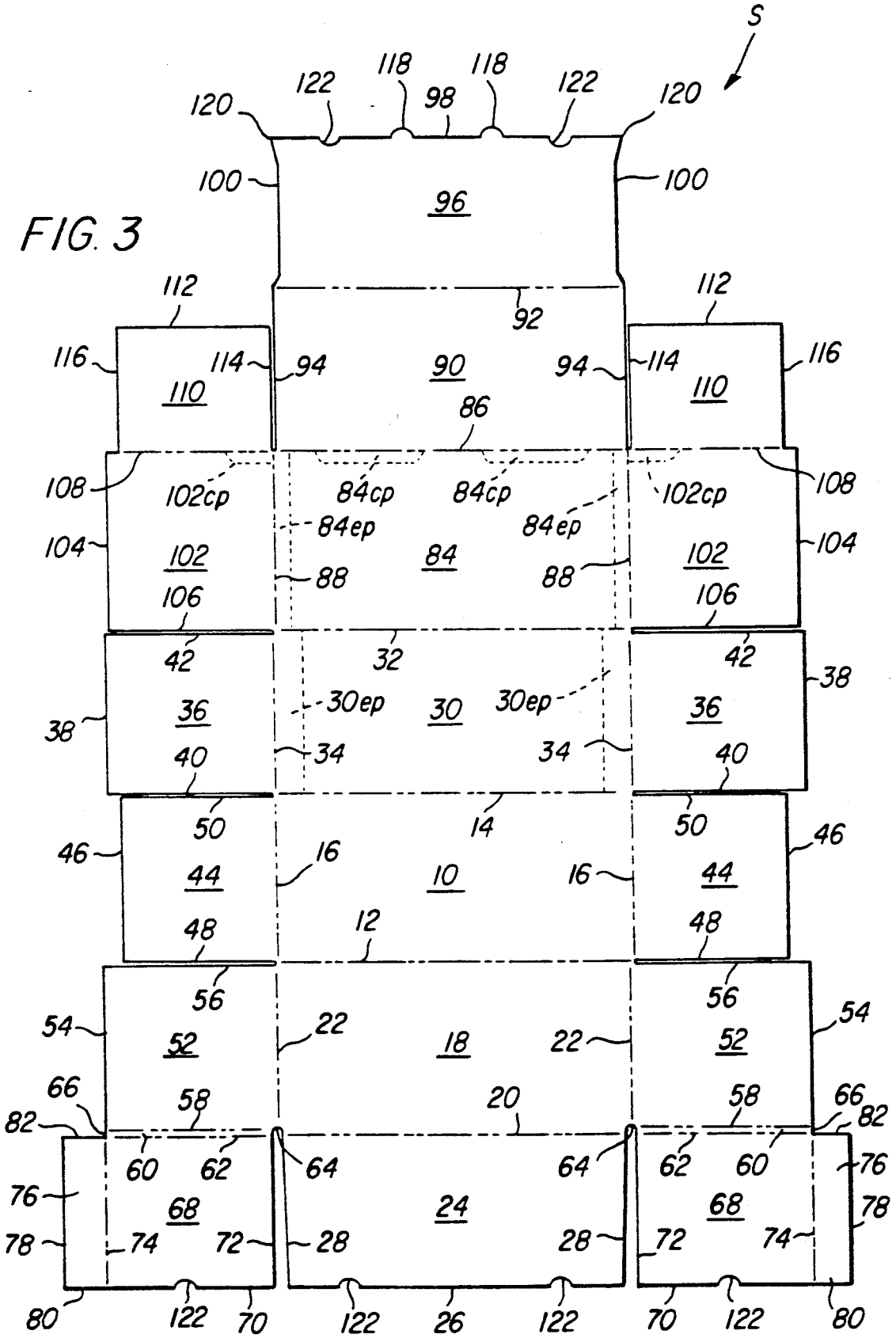
FIG. 3 is a top-plan view of a paperboard blank specially configured to form the package of FIGS. 1 and 2 in accordance with the preferred embodiment.

The box and lid walls are all formed from a single sheet, or blank, of corrugated paperboard that has been specially configured and creased and/or scored so as to be readily foldable along defined fold lines to provide the light-tight package P. As depicted in FIG. 3, the sheet or blank S includes a plurality of panels and flaps that are adapted to be folded about such fold lines into various cooperative relationships to form the box and lid walls. More particularly, the paperboard blank S comprises the following:

a rectangular box bottom wall panel 10 defined by longitudinal box-bottom-wall front and rear fold lines 12 and 14 and transverse box-bottom-wall opposite end fold lines 16;

a rectangular box-front-wall outer panel 18 defined by the box-bottom-wall front fold line 12, a longitudinal box-front-wall fold line 20, and transverse box-front-wall outer-panel opposite end fold lines 22;

a box-front-wall inner panel 24 defined by the box-front-wall fold line 20, a substantially longitudinal box-front-wall inner-panel bottom edge 26, and transverse box-front-wall inner-panel opposite end edges 28;

a rectangular box-rear-wall panel 30 defined by the box-bottom-wall rear fold line 14, a longitudinal box-rear-wall fold line 32, and transverse box-rear-wall opposite end fold lines 34;

box-opposite-end-wall inner-intermediate panels 36 defined by the box-rear-wall opposite end fold lines 34 respectively, transverse box-opposite-end-wall inner-intermediate-panel end edges 38 respectively, and longitudinal box-opposite-end-wall inner-intermediate-panel bottom and top edges 40 and 42;

box-opposite-end-wall outer-intermediate panels 44 defined by the box-bottom-wall opposite end fold lines 16 respectively, transverse box-opposite-end-wall outer-intermediate-panel end edges 46 respectively, and longitudinal box-opposite-end-wall outer-intermediate-panel front and rear edges 48 and 50;

rectangular box-opposite-end-wall outer panels 52 defined by the box-front-wall outer-panel opposite end fold lines 22 respectively, transverse box-opposite-end-wall outer-panel end edges 54 respectively, longitudinal box-opposite-end-wall outer-panel bottom edges 56 respectively, and longitudinal box-opposite-end-wall outer-panel fold lines 58 respectively;

box-opposite-end-wall top panels 60 defined by the box-opposite-end-wall outer panel fold lines 58 respectively, longitudinal box-opposite-end-wall top-panel fold lines 62 respectively, and transverse box-opposite-end-wall top-panel front and rear edges 64 and 66;

box-opposite-end-wall inner panels 68 defined by the box-opposite-end-wall top-panel fold lines 62 respectively, longitudinal box-opposite-end-wall inner-panel bottom edges 70 respectively, transverse box-opposite-end-wall inner-panel front edges 72 respectively, and transverse box-opposite-end-wall inner-panel fold lines 74 respectively;

box-opposite-end-wall inner-panel lightlock flaps 76 defined by the box-opposite-end-wall inner-panel fold lines 74 respectively, transverse box-opposite-end-wall inner-panel lightlock-flap end edges 78 respectively, and substantially longitudinal box-opposite-end-wall inner-panel lightlock-flap bottom and top edges 80 and 82;

a rectangular lid-top-wall panel 84 defined by the box-rear-wall fold line 32, a longitudinal lid-top-wall fold line 86, and transverse lid-top-wall opposite end fold lines 88:

a rectangular lid-front-wall outer panel 90 defined by the longitudinal lid-top-wall fold line 86, a longitudinal lid-front-wall fold line 92, and transverse lid-front-wall outer-panel opposite end edges 94:

a lid-front-wall inner panel 96 defined by the lid-front-wall fold line 92, a substantially longitudinal lid-front-wall inner-panel top edge 98, and transverse lid-front-wall inner-panel opposite end edges 100;

substantially rectangular lid-opposite-end-wall panels 102 defined by the lid-top-wall opposite end fold lines 88 respectively, transverse lid-opposite-end-wall panel end edges 104 respectively, longitudinal lid-opposite-end-wall panel rear edges 106 respectively, and longitudinal lid-opposite-end-wall panel fold lines 108 respectively; and lid-front-wall intermediate partial panels 110 defined by the lid-opposite-end-wall panel fold lines 108 respectively, substantially longitudinal lid-front-wall intermediate-partial-panel end edges 112 respectively, and transverse lid-front-wall intermediate-partial-panel top and bottom edges 114 and 116.

As best seen by reference to all of FIGS. 1-3, the foregoing panels and flaps of blank S are folded about their respective fold lines into various cooperative relationships to form the box and lid walls as follows:

the box-bottom-wall panel 10, as defined by the box-bottom-wall front and rear fold lines 12 and 14 and the box-bottom-wall opposite end fold lines 16, forms the box bottom wall Bb;

the box-front-wall outer and inner panels 18 and 24 are folded about the box-bottom-wall front fold line 12 and the box-front-wall fold line 20, respectively, into adjacent confronting relation with each other to form the box front wall Bf;

the box-rear-wall panel 30 is folded about the box-bottom-wall rear fold line 14 into spaced confronting relation with the folded box-front-wall inner panel 24 to form the box rear wall Br;

the box-opposite-end-wall inner-intermediate panels 36 are folded about the box-rear-wall opposite end fold lines 34, respectively, into spaced confronting relation with each other;

the box-opposite-end-wall outer-intermediate panels 44 are folded about the box-bottom-wall opposite end fold lines 16, respectively, into adjacent confronting relation with the folded box-opposite-end-wall inner-intermediate panels 36 respectively;

the box-opposite-end-wall outer panels 52 are folded about the box-front-wall outer-panel opposite end fold lines 22, respectively, into adjacent confronting relation with the folded box-opposite-end-wall outer-intermediate panels 44 respectively;

the box-opposite-end-wall top panels 60 are folded about the box-opposite-end-wall outer-panel fold lines 58, respectively, into confronting relation with the folded box-opposite-end-wall outer-intermediate-panel end edges 46 respectively and the folded box-opposite-end-wall inner-intermediate-panel top edges 42 respectively;

the box-opposite-end-wall inner panels 68 are folded about the box-opposite-end-wall top-panel fold lines 62, respectively, into adjacent confronting relation with the folded box-opposite-end-wall inner-intermediate panels 36 respectively;

the box-opposite-end-wall inner-panel lightlock flaps 76 are folded about the box-opposite-end-wall inner-panel fold lines 74, respectively, into adjacent confronting relation with opposite end portions 30*ep* of the box-rear-wall panel 30 respectively;

the box-opposite-end-wall outer, outer- and inner-intermediate, inner, and top panels 52, 44 and 36, 68, and 60, so folded, together form the box opposite end walls Be respectively;

the lid-top-wall panel 84, as defined by the box-rear-wall fold line 32, the longitudinal lid-top-wall fold line 86, and the transverse lid-top-wall opposite end fold lines 88, forms the lid top wall Lt;

the lid-opposite-end-wall panels 102 are folded about the lid-top-wall opposite end fold lines 88, respectively, into spaced confronting relation with each other to form the lid opposite end walls Le respectively;

the lid-front-wall intermediate partial panels 110 are folded about the lid-opposite-end-wall panel fold lines 108, respectively, toward and into substantial alignment with each other;

the lid-front-wall outer panel 90 is folded about the longitudinal lid-top-wall fold line 86 into adjacent confronting relation with the folded lid-front-wall intermediate partial panels 110;

the lid-front-wall inner panel 96 is folded about the lid-front-wall fold line 92, over the folded lid-front-wall intermediate-partial-panel bottom edges 116, in between the folded lid-opposite-end-wall panels 102, and into adjacent confronting relation with the folded lid-front-wall intermediate partial panels 110;

the lid-front-wall outer, intermediate partial, and inner panels 90, 110, and 96, so folded, together form the lid front wall Lf; and the lid-top-wall panel 84 is then folded forwardly and downwardly about the box-rear-wall fold line 32 so as to move opposite end portions 84*ep* of the folded lid-top-wall panel 84 into adjacent confronting relation with the folded box-opposite-end-wall top panels 60 respectively, the folded lid-opposite-end-wall panels 102 into adjacent confronting relation with the folded box-opposite-end-wall outer panels 52 respectively, and the folded lid-front-wall inner panel 96 into adjacent confronting relation with the folded box-front-wall outer panel 18, to close the box B and thereby form the light-tight package P for securely containing light-sensitive material.

In this preferred embodiment, the lid-front-wall inner panel 96 includes a pair of shallow tuck tabs 118 protruding from the lid-front-wall inner-panel top edge 98 for engaging corresponding portions 84*cp* of the lid-top-wall panel 84 near the longitudinal lid-top-wall fold line 86, and a pair of shallow angled tabs 120 protruding from the lid-front-wall inner-panel opposite end edges 100 near top edge 98 for engaging corner portions 102*cp* of the lid-opposite-end-wall panels 102 near the intersection of fold lines 88 and 108, as the lid-front-wall inner panel 96 is folded into said adjacent confronting relation with said folded lid-front-wall intermediate partial panels 110, to help retain the lid-front-wall inner panel 96 in its fully folded position.

Also in this embodiment, the lid-front-wall inner-panel top edge 98, the box-front-wall inner-panel bottom edge 26, and the box-opposite-end-wall inner-panel bottom edges 70 each include at least one recessed portion thereof defining a finger opening 122 to facilitate unfolding the lid-front-wall inner panel 96, the box-front-wall inner panel 24, and the box-opposite-end-wall inner panels 68, respectively, for more efficient storage, transport, and/or disposal of the package in "knocked down" form when no longer needed as a light-tight container.

To help ensure the light-tight integrity of package P when fully assembled for normally intended use, lid L is provided with means for maintaining its folded lid-front-wall outer and inner panels 90 and 96 in their adjacent confronting relations with folded lid-front-wall intermediate partial panels 110, and box B is similarly provided with means for maintaining its folded box-opposite-end-wall outer and inner panels 52 and 68 in their adjacent confronting relations with folded box-opposite-end-wall outer-intermediate and inner-intermediate panels 44 and 36 respectively. Such maintaining means may simply comprise adhesive material, e.g., an appropriate grade of case-sealing hot-melt glue, suitably disposed between the interfacing surfaces of those lid and box panels folded into said adjacent confronting relations.

From the foregoing description, it can now be seen that the aforementioned object of this invention has been met by providing, in a practical, cost-effective, and reliable manner, a unitary light-tight flip-top package that is especially adapted for efficient on-line assembly to protectively contain a quantity of photosensitive material, and that also is adapted for convenient opening and light-tight reclosing when in use, and for convenient unfolding to "knocked down" form to facilitate storage, transport, and/or disposal thereof when no longer of use.

While the present invention has been described in detail with particular reference to its preferred embodiment illustrated herein, it will be appreciated by those skilled in the art that variations and modifications can be effected within the spirit and scope of this invention as set forth in the following claims.

I claim:

1. A light-tight package for securely containing light-sensitive material, said package comprising a closable and openable rectanguloid box, said box having a bottom wall, a front wall, a rear wall, and opposite end walls, and a mating lid movably connected to said box rear wall, said lid having a top wall with a front wall and opposite end walls depending therefrom, said box and lid walls all being formed from a single sheet of corrugated paperboard including:

a rectangular box-bottom-wall panel defined by longitudinal box-bottom-wall front and rear fold lines and transverse box-bottom-wall opposite end fold lines;

a rectangular box-front-wall outer panel defined by said box-bottom-wall front fold line, a longitudinal box-front-wall fold line, and transverse box-front-wall outer-panel opposite end fold lines;

a box-front-wall inner panel defined by said box-front-wall fold line, a substantially longitudinal box-front-wall inner-panel bottom edge, and transverse box-front-wall inner-panel opposite end edges;

a rectangular box-rear-wall panel defined by said box-bottom-wall rear fold line, a longitudinal box-rear-wall fold line, and transverse box-rear-wall opposite end fold lines;

box-opposite-end-wall inner-intermediate panels defined by said box-rear-wall opposite end fold lines respectively, transverse box-opposite-end-wall inner-intermediate-panel end edges respectively, and longitudinal box-opposite-end-wall inner-intermediate-panel bottom and top edges;

box-opposite-end-wall outer-intermediate panels defined by said box-bottom-wall opposite end fold lines respectively, transverse box-opposite-end-wall outer-intermediate-panel end edges respectively, and longitudinal box-opposite-end-wall outer-intermediate-panel front and rear edges;

rectangular box-opposite-end-wall outer panels defined by said box-front-wall outer-panel opposite end fold lines respectively, transverse box-opposite-end-wall outer-panel end edges respectively, longitudinal box-opposite-end-wall outer-panel bottom edges respectively, and longitudinal box-opposite-end-wall outer-panel fold lines respectively;

box-opposite-end-wall top panels defined by said box-opposite-end-wall outer-panel fold lines respectively, longitudinal box-opposite-end-wall top-panel fold lines respectively, and transverse box-opposite-end-wall top-panel front and rear edges;

box-opposite-end-wall inner panels defined by said box-opposite-end-wall top-panel fold lines respectively, longitudinal box-opposite-end-wall inner-panel bottom edges respectively, transverse box-opposite-end-wall inner-panel front edges respectively, and transverse box-opposite-end-wall inner-panel fold lines respectively;

box-opposite-end-wall inner-panel lightlock flaps defined by said box-opposite-end-wall inner-panel fold lines respectively, transverse box-opposite-end-wall inner-panel lightlock-flap end edges respectively, and substantially longitudinal box-opposite-end-wall inner-panel lightlock-flap bottom and top edges;

a rectangular lid-top-wall panel defined by said box-rear-wall fold line, a longitudinal lid-top-wall fold line, and transverse lid-top-wall opposite end fold lines;

a rectangular lid-front-wall outer panel defined by said longitudinal lid-top-wall fold line, a longitudinal lid-front-wall fold line, and transverse lid-front-wall outer-panel opposite end edges;

a lid-front-wall inner panel defined by said lid-front-wall fold line, a substantially longitudinal lid-front-wall inner-panel top edge, and transverse lid-front-wall inner-panel opposite end edges;

substantially rectangular lid-opposite-end-wall panels defined by said lid-top-wall opposite end fold lines respectively, transverse lid-opposite-end-wall panel end edges respectively, longitudinal lid-opposite-end-wall panel rear edges respectively, and longitudinal lid-opposite-end-wall panel fold lines respectively; and lid-front-wall intermediate partial panels defined by said lid-opposite-end-wall panel fold lines respectively, substantially longitudinal lid-front-wall intermediate-partial-panel end edges respectively, and transverse lid-front-wall intermediate-partial-panel top and bottom edges;

said box-bottom-wall panel, as defined by said box-bottom-wall front and rear fold lines and said box-bottom-wall opposite end fold lines, forming said box bottom wall;

said box-front-wall outer and inner panels being folded about said box-bottom-wall front fold line and said box-front-wall fold line, respectively, into adjacent confronting relation with each other to form said box front wall;

said box-rear-wall panel being folded about said box-bottom-wall rear fold line into spaced confronting relation with said folded box-front-wall inner panel to form said box rear wall;

said box-opposite-end-wall inner-intermediate panels being folded about said box-rear-wall opposite end fold lines, respectively, into spaced confronting relation with each other;

said box-opposite-end-wall outer-intermediate panels being folded about said box-bottom-wall opposite end fold lines, respectively, into adjacent confronting relation with said folded box-opposite-end-wall inner-intermediate panels respectively;

said box-opposite-end wall outer panels being folded about said box-front-wall outer-panel opposite end fold lines, respectively, into adjacent confronting relation with said folded box-opposite-end-wall outer-intermediate panels respectively;

said box-opposite-end-wall top panels being folded about said box-opposite-end-wall outer-panel fold lines, respectively, into confronting relation with said folded box-opposite-end-wall outer-intermediate-panel end edges respectively and said folded box-opposite-end-wall inner-intermediate-panel top edges respectively;

said box-opposite-end-wall inner panels being folded about said box-opposite-end-wall top-panel fold lines, respectively, into adjacent confronting relation with said folded box-opposite-end-wall inner-intermediate panels respectively;

said box-opposite-end-wall inner-panel lightlock flaps being folded about said box-opposite-end-wall inner-panel fold lines, respectively, into adjacent confronting relation with opposite end portions of said box-rear-wall panel respectively;

said box-opposite-end-wall outer, outer- and inner-intermediate, inner, and top panels, so folded, together forming said box opposite end walls respectively;

said lid-top-wall panel, as defined by said box-rear-wall fold line, said longitudinal lid-top-wall fold line, and said transverse lid-top-wall opposite end fold lines, forming said lid top wall;

said lid-opposite-end-wall panels being folded about said lid-top-wall opposite end fold lines, respectively, into spaced confronting relation with each other to form said lid opposite end walls respectively;

said lid-front-wall intermediate partial panels being folded about said lid-opposite-end-wall panel fold lines, respectively, toward and into substantial alignment with each other;

said lid-front-wall outer panel being folded about said longitudinal lid-top-wall fold line into adjacent confronting relation with said folded lid-front-wall intermediate partial panels; and said lid-front-wall inner panel being folded about said lid-front-wall fold line, over said folded lid-front-wall intermediate-partial-panel bottom edges, in between said folded lid-opposite-end-wall panels, and into adjacent confronting relation with said folded lid-front-wall intermediate partial panels;

said lid-front-wall outer, intermediate partial, and inner panels, so folded, together forming said lid front wall;

said lid-top-wall panel then being folded forwardly and downwardly about said box-rear-wall fold line so as to move opposite end portions of said folded lid-top-wall panel into adjacent confronting relation with said folded box-opposite-end-wall top panels respectively, said folded lid-opposite-end-wall panels into adjacent confronting relation with said folded box-opposite-end-wall outer panels respectively, and said folded lid-front-wall inner panel into adjacent confronting relation with said folded box-front-wall outer panel, to close said box and thereby form said light-tight package for securely containing light-sensitive material.

2. A light-tight package as claimed in claim 1 wherein said lid-front-wall inner panel includes means protruding from said lid-front-wall inner-panel top edge for engaging a corresponding portion of said lid-top-wall panel, near said longitudinal lid-top-wall fold line, as said lid-front-wall inner panel is folded into said adjacent confronting relation with said folded lid-front-wall intermediate partial panels.

3. A light-tight package as claimed in claim 1 wherein said lid-front-wall inner panel includes means protruding from said lid-front-wall inner-panel opposite end edges, near said lid-front-wall inner-panel top edge, for engaging corresponding corner portions of said lid-opposite-end-wall panels, near respective intersections of said lid-top-wall opposite end fold lines and said lid-opposite-end-wall panel fold lines, as said lid-front-wall inner panel is folded into said adjacent confronting relation with said folded lid-front-wall intermediate partial panels.

4. A light-tight package as claimed in claim 1 wherein said lid front wall inner-panel top edge, said box-front-wall inner-panel bottom edge, and said box-opposite-end-wall inner-panel bottom edges each include a recessed portion thereof to facilitate unfolding said lid-front-wall inner panel, said box-front-wall inner panel, and said box-opposite-end-wall inner panels respectively.

5. A light-tight package as claimed in claim 1 wherein said lid includes means for maintaining said folded lid-front-wall outer and inner panels in said adjacent confronting relations with said folded lid-front-wall intermediate partial panels, and said box includes means for maintaining said folded box-opposite-end-wall outer and inner panels in said adjacent confronting relations with said folded box-opposite-end-wall outer-intermediate and inner-intermediate panels respectively.

6. A light-tight package as claimed in claim 5 wherein said lid and box maintaining means include adhesive material disposed between interfacing surfaces of said panels folded into said adjacent confronting relations.

7. A light-tight package as claimed in claim 6 wherein said adhesive material includes case-sealing hot-melt glue.

* * * * *